US007610865B2

(12) United States Patent
Korb

(10) Patent No.: US 7,610,865 B2
(45) Date of Patent: Nov. 3, 2009

(54) TABLE

(75) Inventor: Daniel Korb, Ennetbaden (CH)

(73) Assignee: Herman Miller, Inc., Zeeland, MI (US)

( * ) Notice: Subject to any disclaimer, the term of this patent is extended or adjusted under 35 U.S.C. 154(b) by 147 days.

(21) Appl. No.: 10/560,507

(22) PCT Filed: May 22, 2004

(86) PCT No.: PCT/EP2004/005536

§ 371 (c)(1),
(2), (4) Date: May 22, 2006

(87) PCT Pub. No.: WO2004/111472

PCT Pub. Date: Dec. 23, 2004

(65) Prior Publication Data

US 2006/0278139 A1 Dec. 14, 2006

(30) Foreign Application Priority Data

Jun. 13, 2003 (DE) ..... 103 27 107

(51) Int. Cl.
*A47B 47/00* (2006.01)

(52) U.S. Cl. ..... 108/156; 248/188.8

(58) Field of Classification Search ..... 108/147.12, 108/147.13, 155, 156, 157.1, 153.1, 159, 108/158.11, 158.12, 157.15; 248/188, 188.1, 248/188.8; 403/348, 349
See application file for complete search history.

(56) References Cited

U.S. PATENT DOCUMENTS 561,212 A * 6/1896 Epstein ..... 108/34
586,276 A * 7/1897 Seelinger ..... 108/156
931,327 A * 8/1909 Menzel ..... 279/93
1,745,302 A 1/1930 Jones
2,527,256 A * 10/1950 Jackson ..... 403/319
2,709,818 A 6/1955 Freese ..... 5/332

(Continued)

FOREIGN PATENT DOCUMENTS

DE 28 17 734 A1 11/1978

(Continued)

OTHER PUBLICATIONS

Communication Relating to the Results of the Partial Search Report for PCT/US2007/087784 dated Jul. 8, 2008.

(Continued)

*Primary Examiner*—Janet M Wilkens
(74) *Attorney, Agent, or Firm*—Brinks Hofer Gilson & Lione

(57) ABSTRACT

A piece of furniture, for example, a table, having a frame, supported on legs and carrying a table top, embodied with two parallel separate longitudinal profiles and at least two connected transverse struts and which has hollow recesses, accessible from an underside thereof, for the upper end sections of the legs. A simple and stable leg fixing is thus achieved, whereby coil-section shaped contact elements are arranged on circumferential inner surfaces in the recesses, and contact elements, cooperating with the above for a play-free fixing of the legs, are arranged on the external surface of the end sections, or conversely the spiral section shaped contact elements are embodied on the end sections and the contact elements are embodied in the recesses.

12 Claims, 1 Drawing Sheet

U.S. PATENT DOCUMENTS

| | | | | | |
|---|---|---|---|---|---|
| 3,079,120 | A | * | 2/1963 | Schwartz | 248/188 |
| 3,092,406 | A | | 6/1963 | Wasserstrom | 287/20 |
| 3,131,899 | A | | 5/1964 | Luhrs | 248/188 |
| 3,179,071 | A | | 4/1965 | Johnston | 108/144 |
| 3,236,389 | A | | 2/1966 | Murdock | 211/133 |
| 3,266,840 | A | | 8/1966 | D'Estrube | 297/157 |
| 3,335,471 | A | | 8/1967 | Seckerson et al. | |
| 3,376,068 | A | | 4/1968 | Walkinshaw | 297/437 |
| 3,469,870 | A | | 9/1969 | Barkus | 287/58 |
| 3,478,302 | A | * | 11/1969 | Chirumbolo | 439/314 |
| 3,730,109 | A | | 5/1973 | Kreizel et al. | |
| 3,869,218 | A | * | 3/1975 | Stoeber et al. | 403/241 |
| 4,011,821 | A | | 3/1977 | Neal | |
| 4,127,224 | A | | 11/1978 | Newman, Sr. | |
| 4,305,180 | A | * | 12/1981 | Schwartz | 439/296 |
| 4,329,076 | A | | 5/1982 | Coreth | 403/109 |
| 4,444,125 | A | * | 4/1984 | Welsch et al. | 108/155 |
| 4,474,488 | A | * | 10/1984 | Pinkerton et al. | 403/24 |
| 4,793,611 | A | | 12/1988 | Thornell | 273/1.5 |
| 4,893,426 | A | | 1/1990 | Bixler | 42/75.01 |
| 5,014,923 | A | | 5/1991 | Robertson | 242/55 |
| 5,074,224 | A | * | 12/1991 | Stascheit | 108/156 |
| 5,186,197 | A | * | 2/1993 | Lavine | 135/25.4 |
| 5,417,511 | A | | 5/1995 | Warden | 403/109 |
| 5,513,622 | A | * | 5/1996 | Musacchia, Sr. | 124/89 |
| 5,617,798 | A | | 4/1997 | Lytell | 108/144 |
| 5,657,525 | A | | 8/1997 | Hoyt, III et al. | 29/407.01 |
| 5,741,084 | A | * | 4/1998 | Del Rio et al. | 403/349 |
| 5,868,533 | A | * | 2/1999 | Fiala | 408/226 |
| 6,007,268 | A | | 12/1999 | Whittington et al. | 403/328 |
| 6,499,907 | B1 | | 12/2002 | Baur | 403/188 |
| 6,629,506 | B2 | | 10/2003 | Park | 108/156 |
| 6,659,410 | B1 | * | 12/2003 | Lu | 248/188 |
| 6,776,106 | B2 | * | 8/2004 | Lin | 108/157.1 |
| 6,869,245 | B2 | | 3/2005 | Cabiran | 403/188 |
| 7,044,863 | B1 | * | 5/2006 | Brewster | 473/129 |
| 2003/0231927 | A1 | * | 12/2003 | Hale | 403/349 |
| 2006/0278139 | A1 | | 12/2006 | Korb | |

FOREIGN PATENT DOCUMENTS

| | | | |
|---|---|---|---|
| DE | 195 18 007 | C1 | 7/1996 |
| DE | 198 12 300 | A1 | 9/1999 |
| FR | 770.609 | | 9/1934 |
| FR | 1.328.462 | | 5/1963 |
| FR | 1.411.799 | | 9/1965 |
| GB | 832943 | | 4/1960 |
| WO | WO 2004/111472 | | 12/2004 |
| WO | WO 2008/079778 | A3 | 7/2008 |

OTHER PUBLICATIONS

International Search Report and the Written Opinion of the International Searching Authority for PCT/US2007/087784 dated Nov. 3, 2008.

* cited by examiner

TABLE

BACKGROUND OF THE INVENTION

1. Field of the Invention

This invention relates to a piece of furniture, such as a table, a chair or a stand or the like, having a support structure, which supports a receiving unit and is supported on legs or at least by one support and has hollow receivers, axially accessible from its side, which are at least partially in cross section, for an end section of the leg or the support.

2. Discussion of Related Art

U.S. Pat. No. 4,011,821 teaches a piece of furniture, in particular a table, where the upper end sections of the legs are inserted into cylindrical receivers and are fixed in place on the support structure in the form of a frame of linear and transverse profiled sections. Although, as a result of the separate attachable legs, such tables can be stored in small packaging units and transported, the attachment of the legs is not easy, in particular in the event of large clamping forces, or if not solid in case of low insertion forces.

SUMMARY OF THE INVENTION

One object of this invention is to provide a piece of furniture of the type mentioned above but in which each leg or each support can be dependably and solidly attached with as small as possible a cost outlay and with simple manipulation.

This object is achieved with a piece of furniture having characteristics discussed in this specification and in the claims.

Some engagement elements in the form of helical segments are formed in the receivers on a respectively at least partially encircling inside, and counter-engagement elements are formed on the respective outside of the end sections, which work together for fixing the legs in place free of play. In the opposite way, the engagement elements in the form of spirals are formed at the end sections and the counter-engagement elements in the receivers. With the engagement elements in the form of helical segments and the counter-engagement elements matched to them, it is possible to attach the legs or supports dependably and solidly to the frame without additional further elements and by simple manipulation, wherein the clamping of the legs in the receivers takes place by a simple insertion and turning movement. Simple release by turning is also possible.

Thus steps are advantageous for manipulation and connection wherein two engagement elements in the form of grooves are located opposite each other, offset by 180°, each of which has an insertion element extending in an axis-parallel direction. The engagement elements are embodied as peg-shaped protrusions matched to the grooves in order to create a fixation of the table legs in the form of a quarter-turn fastener.

In this case a particularly solid clamping is achieved because the receiver and the end section are correspondingly embodied conically tapering toward a free end of the end section, for example upwardly with respect to the erected table and are dimensioned so that the end section can be introduced with play with respect to the receiver in the axial direction and can be fixed in place by subsequent rotation, while supported free of play at the conical inside.

Furthermore, those steps contribute to a solid connection and support wherein the arrangement of the engagement elements and counter-engagement elements, as well as the dimensioning of the receiver and the end section, are laid out so that, with the leg attached, the upper front side of the leg is supported on an upper inner surface of the receiver.

The steps, wherein the receivers in the form of separate inserts made of plastic or metal are fixed in place in respectively matched recesses in linear profiled elements or transverse struts of the support structure, for example in the shape of a frame, are also advantageous for manufacturing and a simple structure.

A simple construction is possible if the linear profiled elements and/or the transverse struts are embodied as hollow profiled elements which, for introducing the inserts, have openings on their underside which are matched to the exterior cross section of the inserts. Thus, it is possible to use simple basic elements for constructing the frame.

The steps, wherein the inserts are designed in a cup shape or hat shape with an open underside, and are pressed or glued into the respective recess, or are riveted or screwed from the top of the linear profiled element or transverse strut, are also advantageous for manufacturing and assembly.

Further advantages for construction and assembly are achieved if on their underside the inserts have a collar which, in the inserted state, rests like a flange against the respective underside of the linear profiled element or the transverse strut and/or have a snap-in groove or snap-in projection working together with a lower wall of the linear profiled element or the transverse strut.

The linear profiled elements are designed as four-edged hollow profiled sections and thus contributes to a simple structure.

An altogether solid table structure results if the axes of the receivers are aligned obliquely upward and, with respect to the table, inward.

BRIEF DESCRIPTION OF THE DRAWINGS

This invention is explained in greater detail in view of exemplary embodiments, making reference to the drawings, wherein.

DESCRIPTION OF PREFERRED EMBODIMENTS

Figure 1:
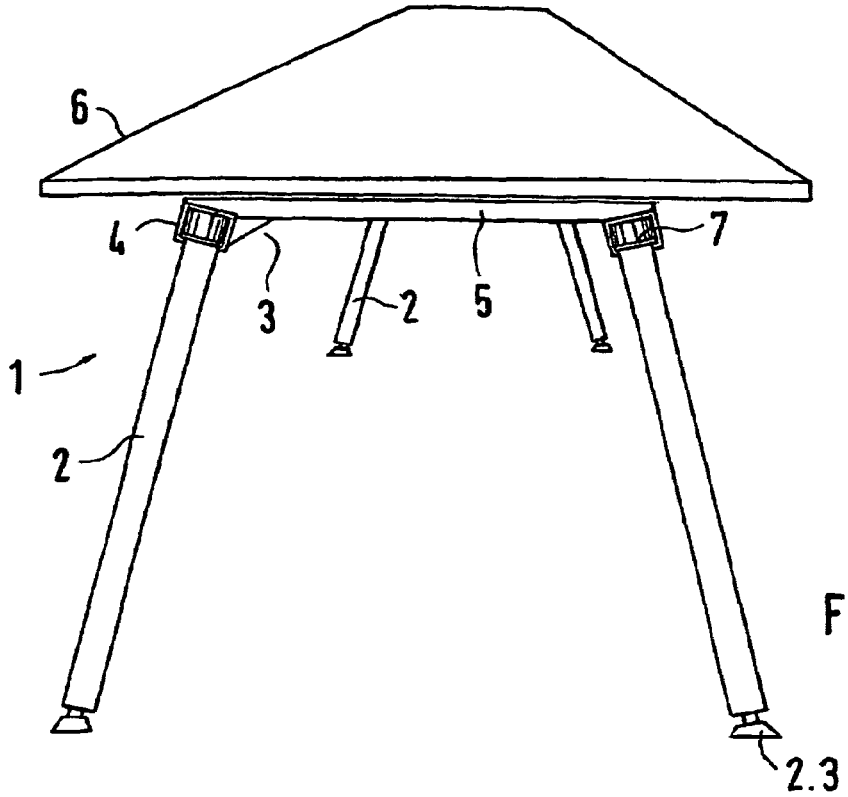
FIG. 1 is a perspective plan view of a table with leg attachment areas formed on the table frame.

As shown in FIG. 1, the piece of furniture in the form of a table has a table frame 1 with a support structure in the form of a frame 3 supported on legs 2, which is formed by linear profiled elements 4, spaced apart parallel and transverse struts 5 connecting them, and which solidly supports a preferably rectangular table top 6 on its top attached to the two linear profiled elements 4 and/or the transverse struts 5. Here, the linear profiled elements 4 are offset from a center line respectively in the direction toward the front and toward back of the table top 6, so that a solid seating of the table top 6 results. The linear profiled elements 4 are designed as closed four-edged hollow profiled sections with a rectangular or square cross section. The transverse struts 5 can also have profiled sections rectangular in cross section, and can be designed to be relatively flat, such as of a relatively large width in comparison with their height, so that a relatively large surface for connection with the linear profiled elements 4 can be achieved.

Figure 2:
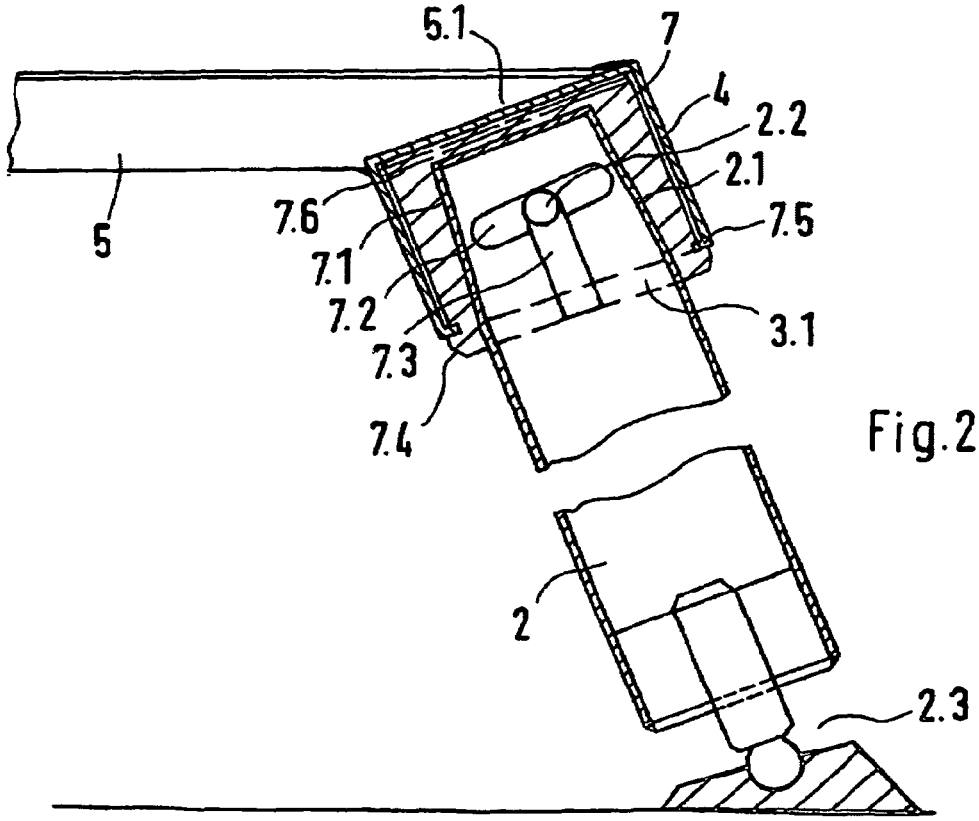
FIG. 2 is an enlarged representation of a leg attachment area, partially in cross section.

As shown in FIGS. 1 and 2, in the exemplary embodiment the table legs 2 are arranged in the shape of the letter A, so that a solid overall support of the table on the floor results. For achieving the A-shaped arrangement, the vertical transverse axis of the linear profiled elements is inclined obliquely upwards and inward in relation to the center longitudinal line of the table. On their underside, the end sections of the transverse struts 5 are beveled to correspond to the obliquely extending top of the linear profiled element 4 and are attached to the top of the linear profiled element 4, wherein the top of the transverse struts 5 is approximately flush with the uppermost edge of the linear profiled element 4. The lower lying upper edge of the linear profiled element 4 is approximately flush with the underside of the transverse strut 5. For a flat support of the inclined table legs 2 on the floor, a base 2.3 is attached to their underside, having a height and inclination that can be adjusted.

An essential particular feature of this table is the design of the leg attachment areas, as shown in greater detail in FIG. 2. Receivers for the upper end sections 2.1 of the table legs, designed as separate inserts 7, are introduced into the respective openings on the underside of the linear profiled element 4 in the leg attachment areas. The inserts 7, for example made of strong plastic or of metal, have an inner receiver, circular in cross section, with an inside 7.1, which extends conically upwards. Two helical-section-shaped grooves located opposite each other are formed in the inside 7 as engagement elements 7.2, which have groove-shaped insertion openings 7.3 extending in the direction toward the lower edge in an axis-parallel direction. The insertion openings 7.3 terminate substantially in the lower portion of the helical-section-shaped grooves 7.2. The helical-section-shaped grooves 7.2 extend with a slight rise with respect to the horizontal position of the insert 7.

The upper end section 2.1 of the table leg 2 to be introduced into the conical inner receiver is correspondingly conically shaped like the inside 2.1 of the insert 7 and matched to it, and on an outside has peg-shaped protrusions 2.2 as engagement elements 2.2. For example, the protrusions 2.2 are the free protruding ends of a bolt diametrically extending through the upper end sections 2.1. For attaching the leg 2, its upper end section 2.1 is introduced into the inner receiver, during which the diametrically oppositely located protrusions are inserted into the respective insertion openings 7.3 up to the helical-section-shaped grooves 7.2. Then, the leg is turned, corresponding to the helical-section-shaped grooves 7.2 into the inner receiver. The dimensioning of the upper corner section 2.1 and of the inner receiver, as well as the engagement elements 7.2 and the peg-like protrusions 2.2 are laid out so that, in the course of turning, the upper end section 2.1 is drawn into the inner receiver until it is firmly clamped with its outer circumference against the inside 7.1 of the inner receiver. The dimensioning can be laid out so that in the fixed state the leg is supported with its upper front end against the inside of an upper cover wall of the insert 7, because of which the table leg 2 is additionally supported in the inserted state. No tool is required for fixing the table leg 2 in place in the inner receiver.

On its exterior, the insert 7 has the shape of a circular cylinder and has a collar 7.4 on its underside which, in the inserted state, rests flange-like around the opening 4.1 matched to the outer diameter of the cylindrical portion on the underside of the linear profiled element 4. Here, the linear extension of the cylinder-shaped section is selected so that the cover wall rests with its outside against the inside of the upper wall of the linear profiled element 4. In order to achieve a definite installed position of the insert 7 with respect to the linear profiled element 4 also in the direction of rotation, and to prevent the insert 7 from rotating along when fixing the leg 2 in place, the insert 4 is attached off-center on the linear profiled element 4 in the area of its upper cover wall, for example with a rivet or a screw. Gluing or clamping in place, or a combination of these fastening steps, is also possible. A different shape of the outer cross section of the insert 7 is also possible, for example angular, or round with one flattened lateral section. However, the round design is preferred because of manufacturing and mounting advantages. Furthermore, a structure with a vertical orientation of the table legs 2 is also possible.

It is also possible to provide a table with only one leg with a leg fastening of the above described structure.

Similar to the way explained above with a table, the fixation in place of, for example legs or bases or supports of other pieces of furniture, for example carcass furniture, stands or chairs, can take place, because the flat support of the end section of the leg, base or of another support on the at least partially encircling inside of the receiver 7 results in a firm support, in particular also against transverse forces.

It is also possible to fix a leg or a support with its appropriately designed end section reversed or in addition in a lower base section, for example designed plate-like, in which a receiver, then open at the top, of the previously described type is cut or inserted.

The invention claimed is:

1. A piece of furniture comprising:

at least one leg;

a hollow receiver shaped to receive an end section of the at least one leg, wherein the hollow receiver comprises a first engagement element formed as a helical segment at least partially encircling an inside of the hollow receiver, and a first counter-engagement element formed on a respective outside of the end section of the leg;

wherein the first engagement element engages the first counter-engagement element for fixing the leg in place free of play;

wherein the receiver is formed as a separate insert fixed in place in a respectively matched recess in a socket member; and wherein the insert engages the socket with a snap fit;

wherein the first engagement element and a second engagement element are formed as grooves and are located opposite each other offset by 180°, each of which has an insertion element extending in an axis-parallel direction, and the first counter-engagement element and a second counter-engagement element are peg-shaped protrusions matched to the grooves of the respective first and second engagement elements;

wherein the receiver and the end section of the leg are correspondingly embodied to be conically tapering toward a free end of the end section and dimensioned so that the end section is introduced with play with respect to the receiver in the axial direction and is fixed in place by subsequent rotation, while supported free of play at a conical inside;

wherein the engagement elements and counter-engagement elements, as well as a dimensioning of the receiver and the end section are laid out so that, with the leg attached, an upper front side of the leg is supported on an upper inner surface of the receiver; and wherein the socket member is a hollow profiled element which includes openings on an underside that are matched to an exterior cross section of the insert.

2. The piece of furniture in accordance with claim 1, wherein the insert is in one of a cup shape and a hat shape and is one of pressed and glued into the respective recess, riveted, and screwed from a top of the socket member.

3. A piece of furniture comprising:

at least one leg;

a hollow receiver shaped to receive an end section of the at least one leg, wherein the hollow receiver comprises an engagement element formed as a helical segment at least partially encircling an inside of the hollow receiver, and a counter-engagement element formed on a respective outside of the end section of the leg;

wherein the engagement element engages the counter-engagement element for fixing the leg in place free of play;

wherein the receiver is formed as a separate insert fixed in place in a respectively matched recess in a socket member; and wherein the insert engages the socket with a snap fit;

wherein the receiver is made of one of a plastic and a metal; and wherein the socket member is a hollow profiled element which includes openings on an underside that are matched to an exterior cross section of the insert.

4. A piece of furniture, comprising:

a leg comprising a pin extending radially outward on opposite sides of the leg;

a socket member;

a mounting component received in the socket member having a pair of opposed axial slots receiving portions of said pin extending radially from the leg, wherein the pin is moveable in the slots, such that the leg is axially moveable relative to the mounting component, wherein the mounting component further comprises a helical engagement member following a continuously upward rise in a first rotational direction, with the helical engagement member continuously drawing the leg into the socket when the leg is rotated relative to the socket in the first direction;

wherein the pin does not penetrate beyond an outer surface of the mounting component.

5. The piece of furniture of claim 4, wherein the socket member is secured to an underside of a work surface on the piece of furniture.

6. The piece of furniture of claim 5, wherein the socket member is one of pressed and glued into a mating recess in the piece of furniture.

7. The piece of furniture of claim 5, wherein the axis of the mounting component is aligned obliquely upward and inward with respect to the work surface.

8. The piece of furniture of claim 4, wherein the mounting component is made of one of a plastic and a metal.

9. The piece of furniture of claim 4, wherein the leg is a hollow tube.

10. The piece of furniture of claim 4 wherein the helical engagement member is a slot.

11. The piece of furniture of claim 10 wherein the helical engagement member communicates with the axial slot.

12. The piece of furniture of claim 11 wherein the pin travels in the axial slot and helical engagement member.

* * * * *